US010898819B2

(12) United States Patent
Tiffin et al.

(10) Patent No.: US 10,898,819 B2
(45) Date of Patent: Jan. 26, 2021

(54) TOY VEHICLE TRACK SYSTEMS AND CONNECTORS FOR SAME

(71) Applicant: Mattel, Inc., El Segundo, CA (US)

(72) Inventors: Andrew D. Tiffin, Thousand Oaks, CA (US); Benny M. Binshtock, Calabasas, CA (US); David Welby, Santa Monica, CA (US)

(73) Assignee: Mattel, Inc., El Segundo, CA (US)

( * ) Notice: Subject to any disclaimer, the term of this patent is extended or adjusted under 35 U.S.C. 154(b) by 252 days.

(21) Appl. No.: 16/013,620

(22) Filed: Jun. 20, 2018

(65) Prior Publication Data

US 2018/0369705 A1 Dec. 27, 2018

Related U.S. Application Data

(60) Provisional application No. 62/523,054, filed on Jun. 21, 2017.

(51) Int. Cl.
*A63H 18/02* (2006.01)
*A63H 18/08* (2006.01)

(52) U.S. Cl.
CPC ..... *A63H 18/02* (2013.01); *A63H 18/08* (2013.01)

(58) Field of Classification Search
CPC ..... A63H 18/00; A63H 18/02
See application file for complete search history.

(56) References Cited

U.S. PATENT DOCUMENTS 3,228,607 A 1/1966 Robinette et al.
3,581,988 A 6/1971 Kin et al.
3,624,956 A 12/1971 Dunn et al.
3,712,539 A 1/1973 Staats
3,712,540 A 1/1973 Yamasaki et al.
3,747,262 A 7/1973 Endres
4,054,393 A 10/1977 Talleri
4,397,419 A 8/1983 Fischer
4,461,116 A 7/1984 Bach
4,519,724 A 5/1985 Ribas
5,405,080 A 4/1995 Yeung et al.
5,579,997 A 12/1996 Jackson et al.
5,794,846 A 8/1998 Barrett
6,601,774 B1 8/2003 Kasimoff
(Continued)

FOREIGN PATENT DOCUMENTS

CN 204147548 U 2/2015
CN 204232439 U 4/2015

*Primary Examiner* — Robert J McCarry, Jr.
(74) *Attorney, Agent, or Firm* — Kolisch Hartwell, P.C.

(57) ABSTRACT

Toy vehicle track systems and connectors for those systems are disclosed. The connectors include a central portion, first and second end portions, and first and second side portions. The central portion includes first and second posts, and a third larger post disposed between the first and second posts. In some embodiments, the third post includes a living hinge to allow for increased vertical displacement of the first, second, and/or third posts when a downward force is applied to the third post. In some embodiments, the central portion includes descending and ascending parts to allow for increased vertical displacement of the first, second, and/or third posts when a downward force is applied to the third post. In some embodiments, the connectors include a plurality of bumps to increase frictional engagement between the connector and the track sections.

10 Claims, 14 Drawing Sheets

(56) References Cited

U.S. PATENT DOCUMENTS

| | | | | |
|---|---|---|---|---|
| 7,111,560 | B1 | 9/2006 | Frost | |
| D718,822 | S | 12/2014 | Lee | |
| 9,061,218 | B2 | 6/2015 | DiBartolo et al. | |
| 9,345,980 | B2 * | 5/2016 | Lee | A63H 18/02 |
| 10,028,561 | B2 | 7/2018 | Vecillio | |
| D828,879 | S | 9/2018 | Tiffin et al. | |
| D828,880 | S | 9/2018 | Tiffin et al. | |
| 2005/0247800 | A1 | 11/2005 | Pyrce | |
| 2005/0287905 | A1 | 12/2005 | Olivier | |
| 2006/0080928 | A1 | 4/2006 | Kichijo et al. | |
| 2012/0324708 | A1 | 12/2012 | Minin | |
| 2014/0084074 | A1 | 3/2014 | O'Connor et al. | |
| 2015/0097046 | A1 | 4/2015 | Lee | |
| 2016/0228783 | A1 | 8/2016 | Fiebig et al. | |

* cited by examiner

TOY VEHICLE TRACK SYSTEMS AND CONNECTORS FOR SAME

CROSS-REFERENCE TO RELATED APPLICATIONS

This application is based upon and claims the benefit under 35 U.S.C. § 119(e) of U.S. Provisional Patent Application Ser. No. 62/523,054, filed Jun. 21, 2017, which is incorporated herein by reference in its entirety for all purposes.

BACKGROUND

Flexible, plastic track or roadway systems for toy vehicles are known in the prior art as exemplified by a patent to Nash et al., U.S. Pat. No. 3,487,999, issued Jan. 6, 1970, to the assignee of the present disclosure, and has been marketed extensively under the trademark "HOT WHEELS." The track systems disclosed in the above-mentioned patent have functioned exceedingly well for toy vehicles of a relatively small scale; that is, vehicles having a width of about 1 to 1¼ inches while the track section width is about 1½ inches.

A concern for any toy track system is that it be economically manufactured. Since a track system of synthetic resin material provides sufficient durability to withstand abuse and flexibility to allow twisting and curving to enable various track system layouts, it is desirable to develop a track system where as many as possible of the components are fabricated by an extrusion process. It is also desirable that those components that cannot be extruded instead be easily molded, for economic reasons.

Another form of track connector for use with heavier, modified "Hot Wheels" track sections is disclosed in U.S. Pat. No. 3,712,539. It was the objects of these track sections and connectors to provide a track system having improved strength and stiffening characteristics and to improve the alignment of abutting track sections for use with larger, heavier toy vehicles. It did so by multiplying the flanges projected from the bottom side of the track sections and providing multiple joined connectors to frictionally engage the multiple flanges. While these modifications achieved their desired objects, they also resulted in the track sections being held more firmly together, making it more difficult for children, especially the youngest children that might use such sets, to break down the connected sections. Moreover, the design of the connectors resulted in a height that elevated the connected ends of the adjoining track sections from the surface supporting the track set, which necessitated the additional depending flanges of the track sections to stiffen them. The combination increased the amount of material needed for each track section and connector as well as complicating their fabrication.

It would be desirable to provide track systems of track sections and connectors that meet the objects of improved alignment and securement of adjoining track sections with easy manufacture of the components and separation closer to that of the original track system components.

SUMMARY

The present disclosure relates generally to toy vehicle track systems, and more particularly to track systems for toy vehicles that include connectors securely joining together adjoining track sections while permitting easier release of the sections from the connector and from one another.

In some embodiments, the connectors include a central portion, first and second end portions, and first and second side portions. The central portion includes first and second posts, and a third larger post disposed between the first and second posts. In some embodiments, the third post includes a living hinge to allow for increased vertical displacement of the first, second, and/or third posts when a downward force is applied to the third post. In some embodiments, the central portion includes descending and ascending parts to allow for increased vertical displacement of the first, second, and/or third posts when a downward force is applied to the third post. In some embodiments, the connectors include a plurality of bumps to increase frictional engagement between the connector and the track sections.

Features, functions, and advantages may be achieved independently in various embodiments of the present disclosure, or may be combined in yet other embodiments, further details of which can be seen with reference to the following description and drawings.

DESCRIPTION

Overview

Figure 1:
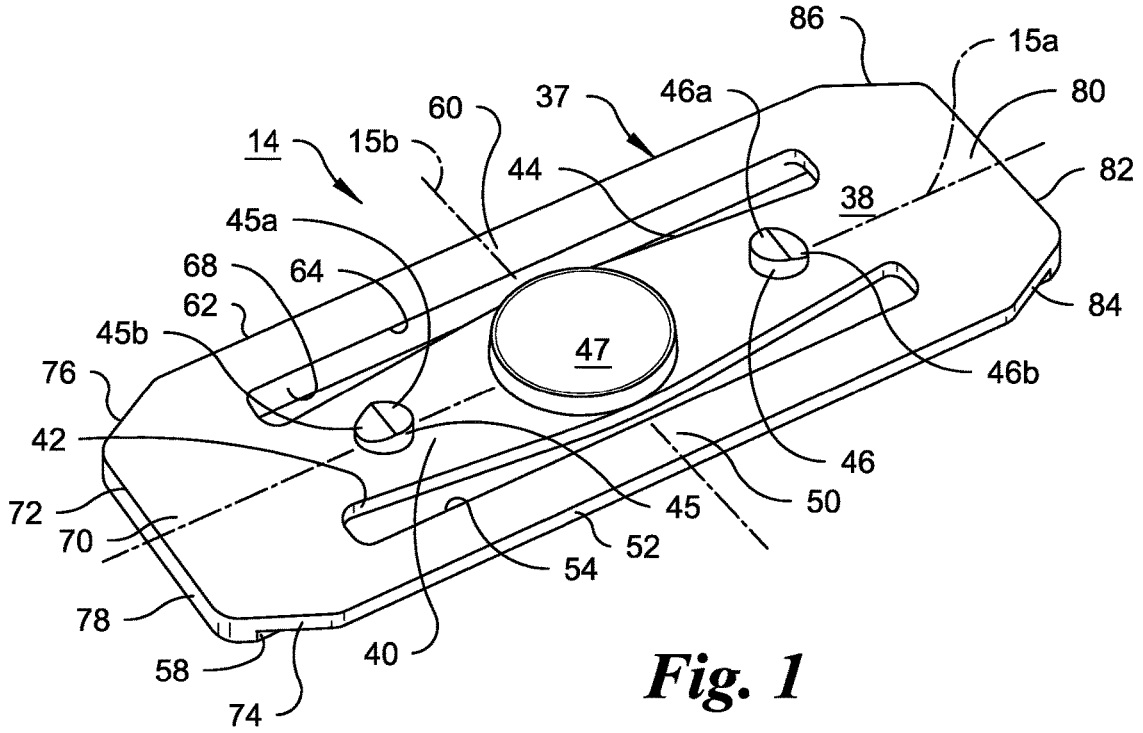
FIG. 1 is a top isometric view of an example of a track connector of the present disclosure.
Figure 2:
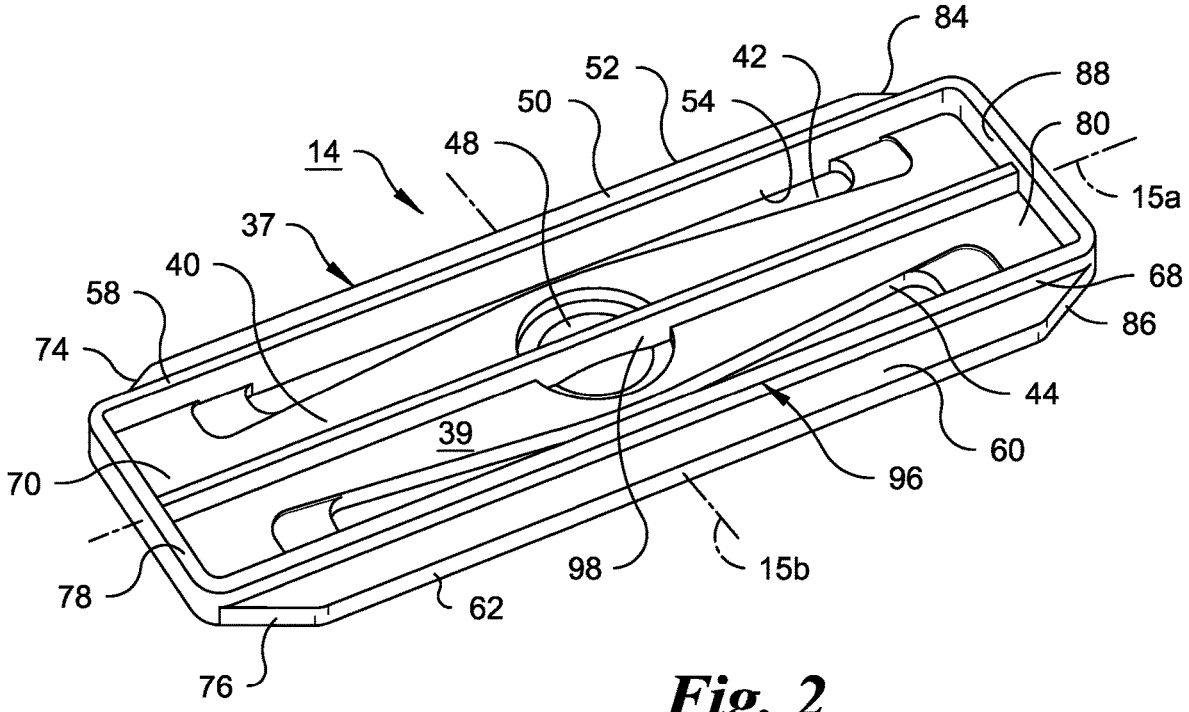
FIG. 2 is a bottom isometric view of the track connector of FIG. 1.
Figure 3:
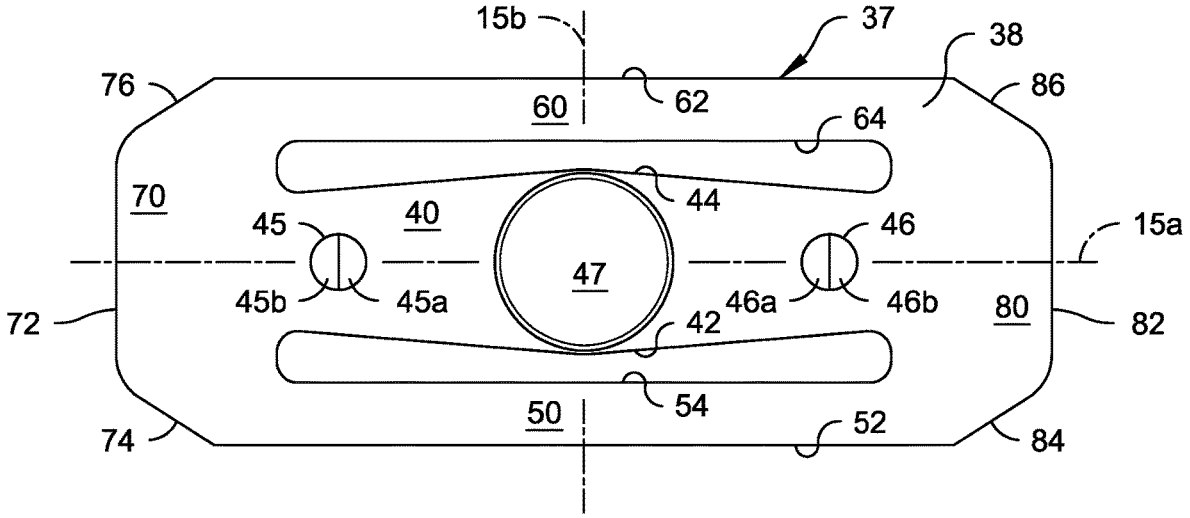
FIG. 3 is a top view of the track connector of FIG. 1.
Figure 4:
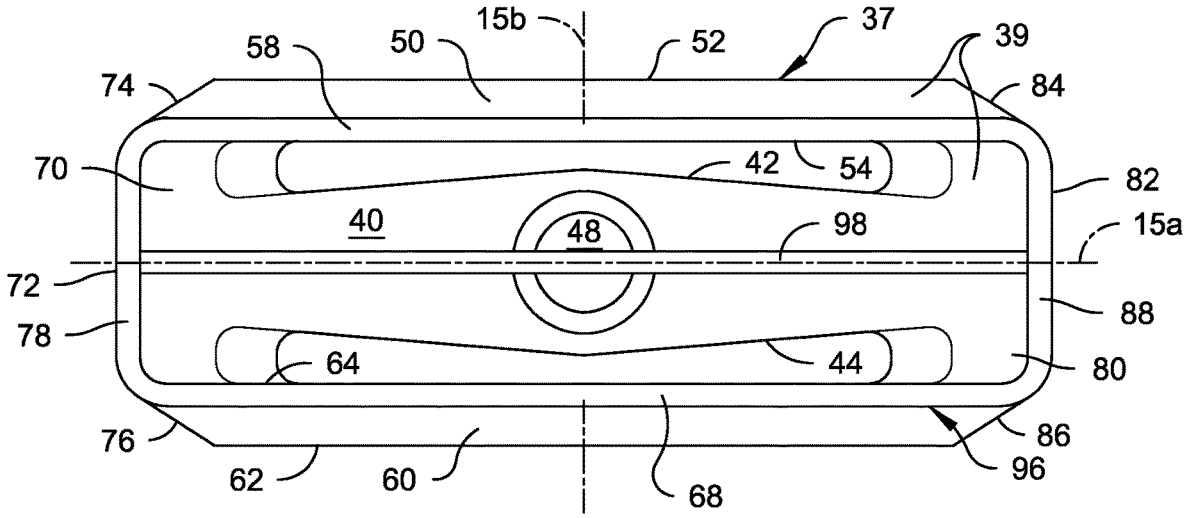
FIG. 4 is a bottom view of the track connector of FIG. 1.
Figure 5:
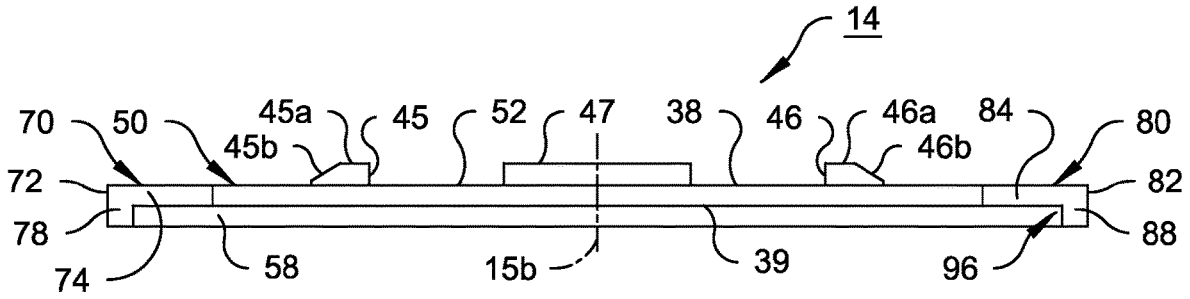
FIG. 5 is a side view of the track connector of FIG. 1.
Figure 6:
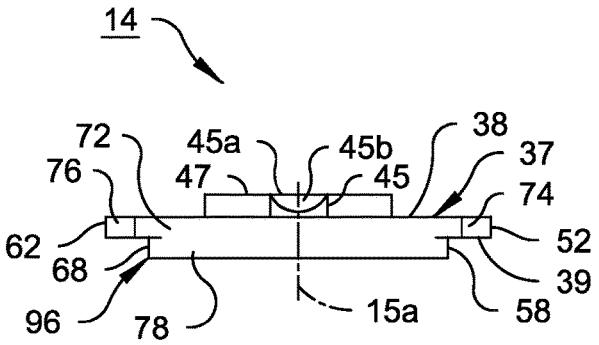
FIG. 6 is an end view of the track connector of FIG. 1.

Various embodiments of toy vehicle track systems and connectors for those systems are described below and illustrated in the associated drawings. Unless otherwise specified, the vehicle track systems, connectors, and/or its various components may contain at least one of the structure, components, functionality, and/or variations described, illustrated, and/or incorporated herein. Furthermore, the structures, components, functionalities, and/or variations described, illustrated, and/or incorporated herein in connection with the present teachings may be included in other similar structures. The description of various embodiments below is merely illustrative in nature and is in no way intended to limit the disclosure, its application, or uses. Additionally, the advantages provided by the embodiments, as described below, are illustrative in nature and not all embodiments provide the same advantages or the same degree of advantages.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the stated component and designated parts thereof. The terminology includes the words above specifically mentioned, derivatives thereof and words of similar import.

EXAMPLES, COMPONENTS, AND ALTERNATIVES

The following sections describe selected aspects of illustrative apparatuses. The examples in these sections are intended for illustration and should not be interpreted as limiting the entire scope of the present disclosure. Each section may include one or more distinct inventions, and/or contextual or related information, function, and/or structure.

Example 1

This example describes an illustrative toy vehicle track system of the present disclosure; see FIGS. 7-10.

Figure 7:
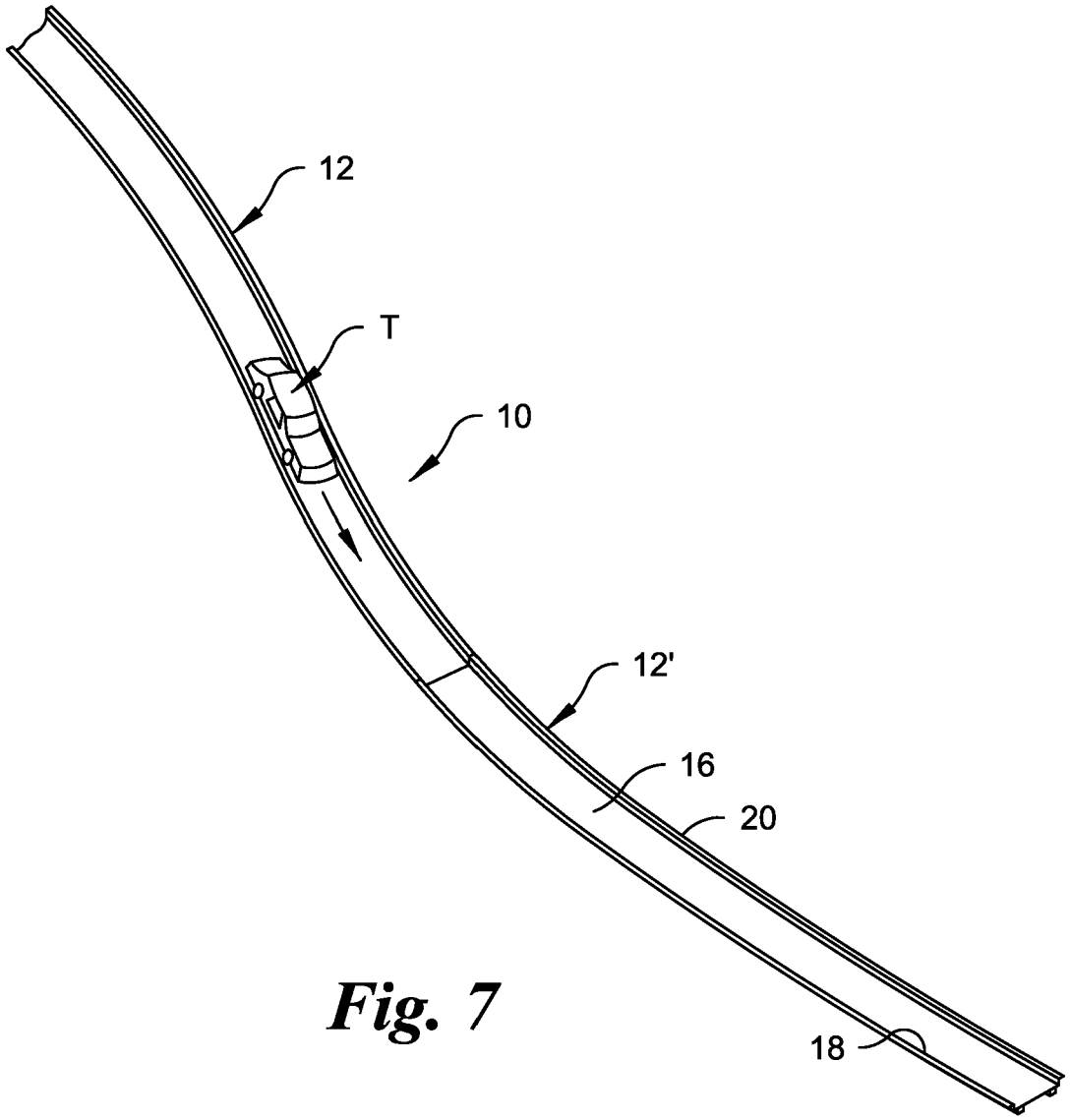
FIG. 7 is an isometric view of a portion of a toy vehicle flexible track system according to the present disclosure utilizing the track connector of FIGS. 1-6.

Referring now to FIG. 7, there is illustrated a toy vehicle flexible track system 10 which includes two adjoining track sections 12, 12' connected by a track connector 14 of the present disclosure, hidden from view beneath the sections 12, 12'. As contemplated for its intended use, a number of track sections of various known geometries (straight, curved, branching, etc.) may be connected in a serial fashion with a number of track connectors, one track connector at each abutment of two track sections. The track system may be laid along a flat surface, such as a floor, or it may be attached at some location above a floor, such as a table top, with the remainder of the track sloping downward toward the floor and along the floor. It is also contemplated that various accessories may be included in any track system layout, including specially designed curves, jump ramps, loops, lane mergers, and various devices for imparting motion to a toy vehicle.

Referring to the various FIGS. 7-10, a toy vehicle T generally rides upon a generally planar, first or upper or top face portion 16 of the track sections 12, 12' and is maintained and guided on the upper face portion by two guide flanges 18 and 20, which are integrally connected to the upper or top face portion 16 and which project obliquely from the face portion 16 of each section 12. Except for openings which are described further below, the depicted straight track sections 12, 12' have an essentially uniform cross-section throughout its length so as to be easily extruded. As already mentioned, the upper face portion 16 is the roadway on which the toy vehicle T moves and the guide flanges 18, 20 keep the toy vehicle T confined to the track section 12. It is contemplated that the width of the upper face 16 is greater than the width of the corresponding toy vehicle T so that the toy vehicle may move in response to a lateral component of movement causing the vehicle to come into contact with one or the other of the two guide flanges. A preferred width for just the upper face is about 2 inches, while the overall width of the track section is about 2⅜ inches. The oblique design of the guide flanges limits area contact with a toy vehicle traversing the track section and reduces excessive frictional engagement, each of which causes the toy vehicle to slow.

Opposite the upper face portion 16 is a second or lower or bottom face portion 22 from which extends two flange elements 24, 26. The flange elements 24, 26 extend parallel to a longitudinal centerline 13*a* of the track section 12 and strengthen and stiffen the track section. The flange elements 24, 26 form a channel indicated at 28 which defines a receptacle for the receipt of the track connector 14. Each of the flange elements 24, 26 has a generally L-shaped cross-section and the flange elements 24, 26 form, with the lower face 22, facing C-shaped enclosures at the side edges of the channel 28 such as the enclosure 30 formed by the flange element 24 and an opposite portion of the lower face 22 and enclosure 32 formed by the flange element 26 and an opposite portion of the lower face 22.

According to the present disclosure, a closed perimeter opening or "hole" 34 and an open perimeter cutout 36 are provided extending entirely through the track section 12, through the upper and lower face portions 16, 22, at each longitudinal, connectable end of the track section 12. In the case of the depicted straight track section 12, hole 34 is provided proximal to and cutout 36 is provided in each longitudinal end edge 35 of the section 12, centered between the guide flanges 18, 20 and flange elements 24, 26. The holes 34 and cutouts 36 are symmetric with respect to the longitudinal centerline 13*a* and a transverse centerline 13*b* of the track section 12. The hole 34 is circular and cutout 36 is semicircular for convenience but each could be of different shapes. As straight track sections 12 are typically cut from longer, continuous extensions (i.e., extrusions), the holes and cutouts can be cut at the same time by the same cutting operation, if desired.

Example 2

This example describes an illustrative connector suitable for connecting track sections of the present disclosure; see FIGS. 1-6.

Referring now to various FIGS. 1-6, to achieve an improved alignment between abutting track sections 12, 12' for stiffening the track section end portions and for providing an improved frictional engagement, the track connector 14 includes an elongated, planar main body 37 with opposing, planar, upper/first and lower/second major surfaces 38, 39. The planar main body 37 is generally rectangular with four angled corner edges 74, 76, 84, 86, each being transverse to both a longitudinal centerline 15*a* of the connector 14 and a transverse centerline 15*b* perpendicular to longitudinal centerline 15*a* of the connector 14.

The planar main body 37 is defined by coplanar elongated central portion 40 with first and second elongated side edges 42, 44, first and second elongated outer portions 50, 60 spaced laterally outwardly respectively from the first and second side edges 42, 44, and first and second end portions 70, 80 joining the central portion 40 and the first and second outer portions 50, 60 and defining opposing elongated ends of the main body 37 and the connector 14. The end portions 70, 80 have respective distal edges 72, 82, between angled edges 74, 76 and 84, 86, respectively.

The main body 37, central portion 40 and end portions 70, 80 have a common longitudinal centerline 15*a* in the elongated direction. The main body 37 and the central and first and second outer portions 40, 50, 60 all have a common transverse centerline 15*b* perpendicular to the longitudinal centerline 15*a*. The centerlines 15*a*, 15*b* are parallel to the plane of the main body 37 and thus each of its planar major sides 38, 39 and each of the portions 40, 50, 60, 70, 80.

First and second posts 45, 46 project outwardly from the planar first major surface 38 of the central portion 40 at positions along the longitudinal centerline 15*a* and symmetric with respect to the transverse centerline 15*b*, and are mirror images of one another with respect to the transverse centerline 15*b*. Each of the first and second posts preferably has a circular cross-section at the planar first major surface 38 and a respective top surface 45*a*, 46*a*, most distal to the planar first major surface 38, with a bevel 45*b*, 46*b* extending downward from approximately midpoints of the top surfaces 45*a*, 46*a* towards the end portion 70, 80, respectively, most proximal to the post 45, 46. Each post maintains a short, semicircular surface below the bevel to engage with the track section 12 it is connecting.

A third post 47 projects outwardly from the planar first major surface 38 between the first and second posts 45, 46, centered with respect to the longitudinal and transverse centerlines 15*a*, 15*b*. The third post has a cross-section at the first major surface 38 larger in area than the circular cross-section of each of the first and second posts 45, 46. Preferably, the cross-section of the third post 47 at the first major surface 38 is circular although it could have other shapes. Preferably also, the third post 47 is hollow and defines a circular recess 48 in the planar second major surface 39.

The connector 14 further includes a plurality of elongated ribs 58, 68, 78, 88 projecting outwardly from the planar second major surface 39 along the first and second outer sections 50, 60 and along the first and second end portions 70, 80, respectively. Two longer ribs 58, 68 project from the planar second major side 39 along inner side edges 54, 64 of the first and second outer portions 50, 60 facing the elongated side edges 42, 44, respectively, of the central portion 40. Ribs 58, 68 are parallel to one another and equal in length. Two shorter ribs 78, 88 extend from end portions 70, 80 parallel to the transverse centerline 15*b* and between adjoining ends of the two longer ribs 58, 68 such that the two longer ribs and the two shorter ribs are connected end to end to form an integral hollow rib frame 96 with a continuous, unbroken, closed circumference. A fifth rib 98 is also preferably provided extending from the end portions 70, 80 and the central portion 40 along the longitudinal centerline 15*a* between the two shorter ribs 78, 88 for additional stiffening. Fifth rib 98 spans the recess 48 of the third post 47 and extends the full depth of the recess 48.

Protrusions (not shown) may be located on inner edges 54, 64 of the outer portions 50, 60 at the transverse centerline 15*b* and face side edges 42, 44, respectively, of central portion 40 where the edges 42, 44 are flared outwardly to accommodate the third post 47 with the maximum extent of flaring being along the transverse centerline 15*b*.

Figure 8:
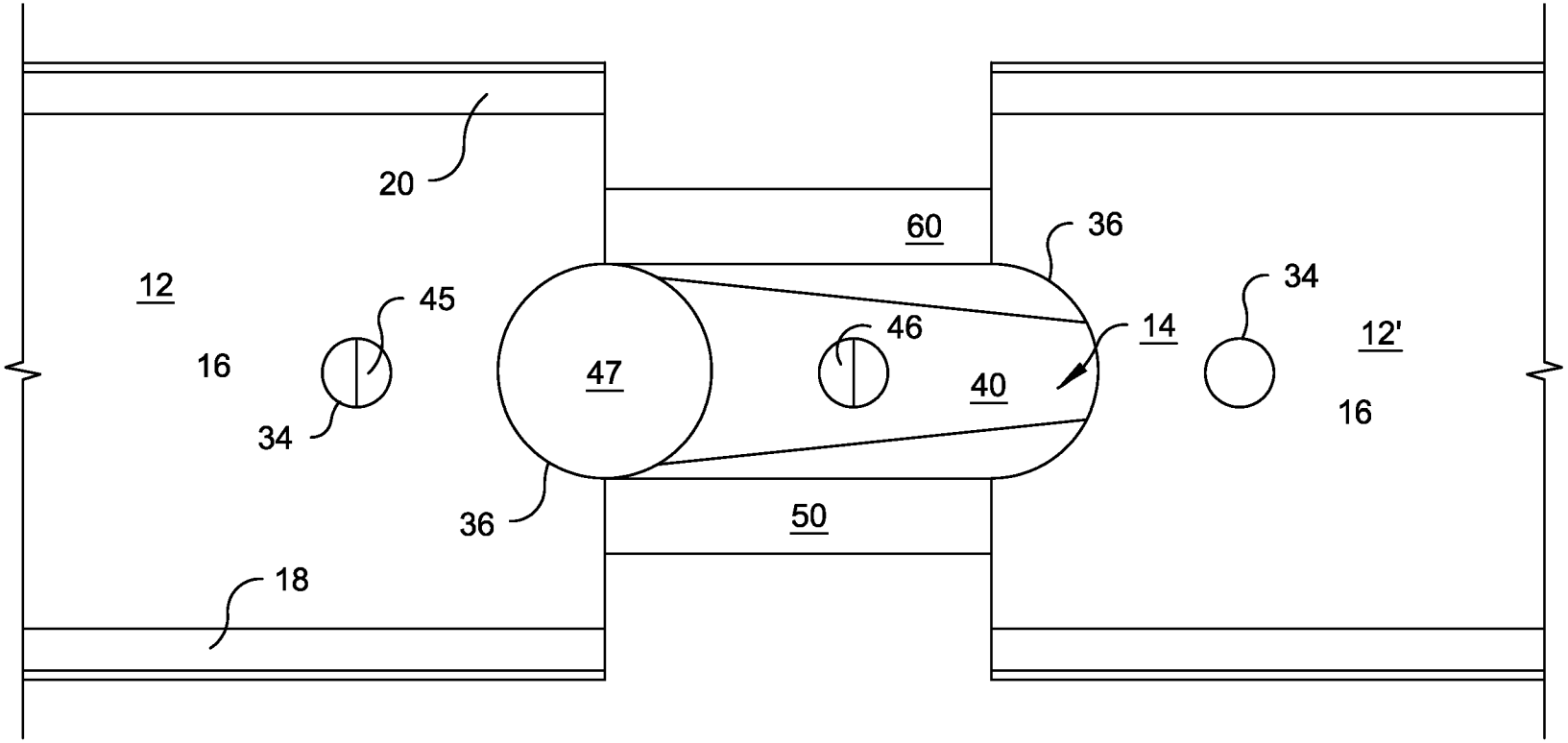
FIG. 8 is a top view of the track connector of FIGS. 1-6 shown joined to a first track section and received within a channel of a second track section of the present disclosure.
Figure 10:
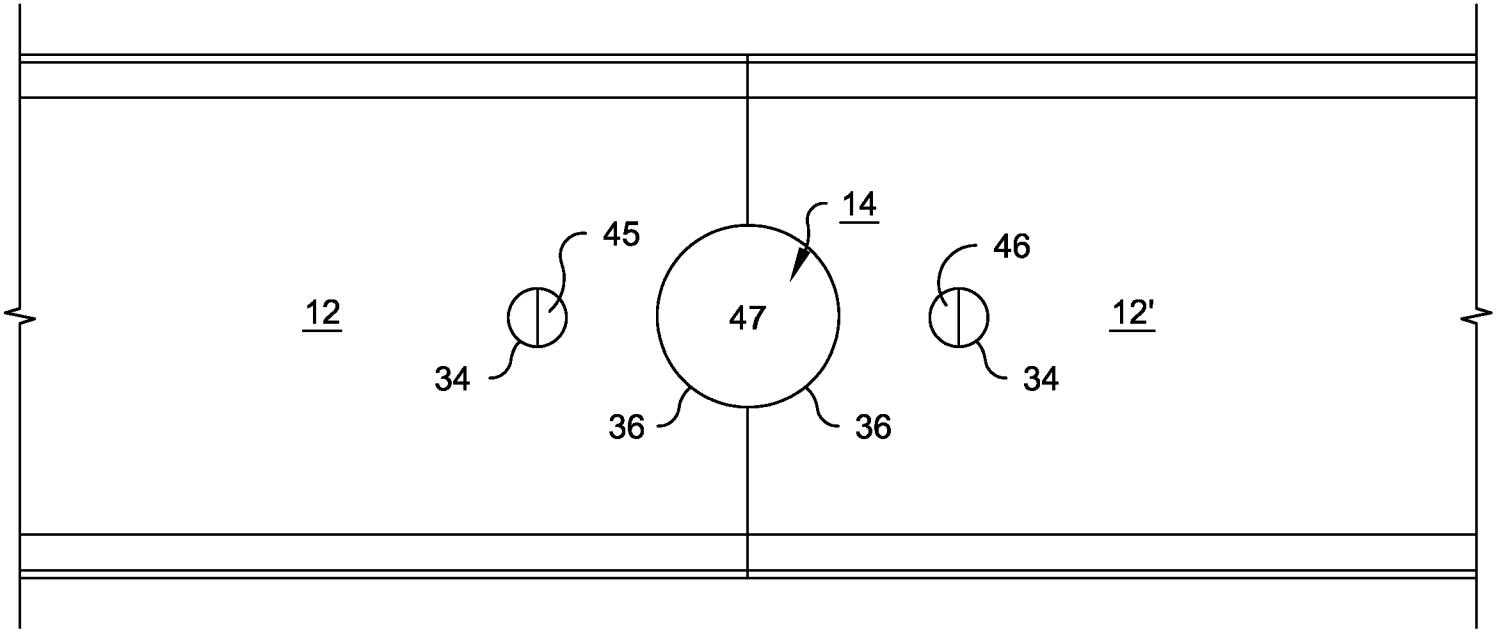
FIG. 10 is a top view of the track connector of FIGS. 8-9 shown with both first and second track sections joined by the track connector.
Figure 11:
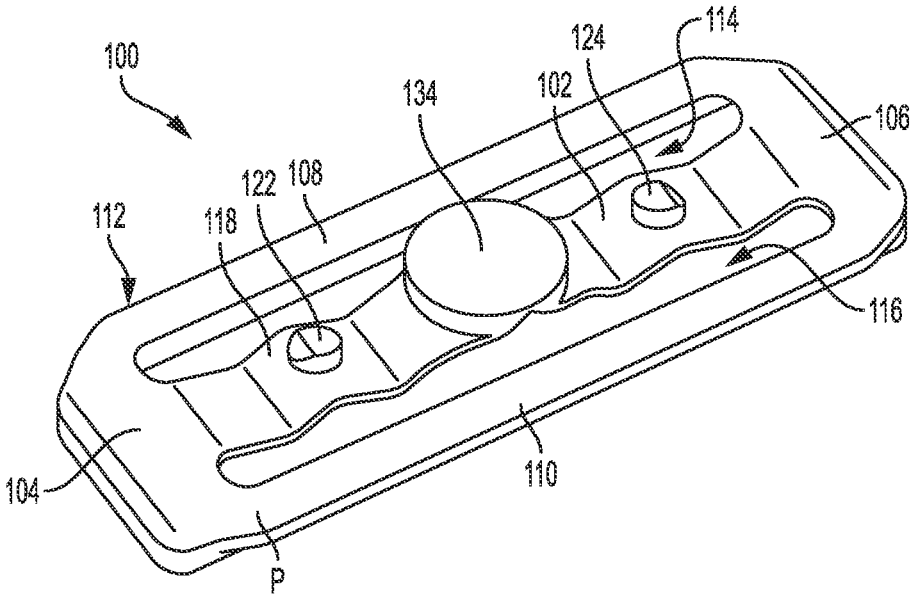
FIG. 11 is a top isometric view of another example of a track connector.
Figure 12:
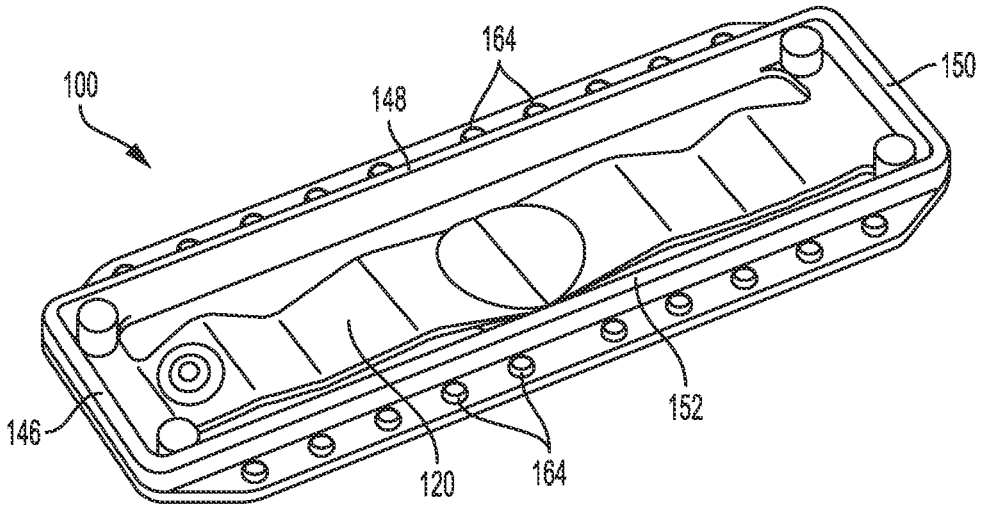
FIG. 12 is a bottom isometric view of the track connector of FIG. 11.
Figure 13:
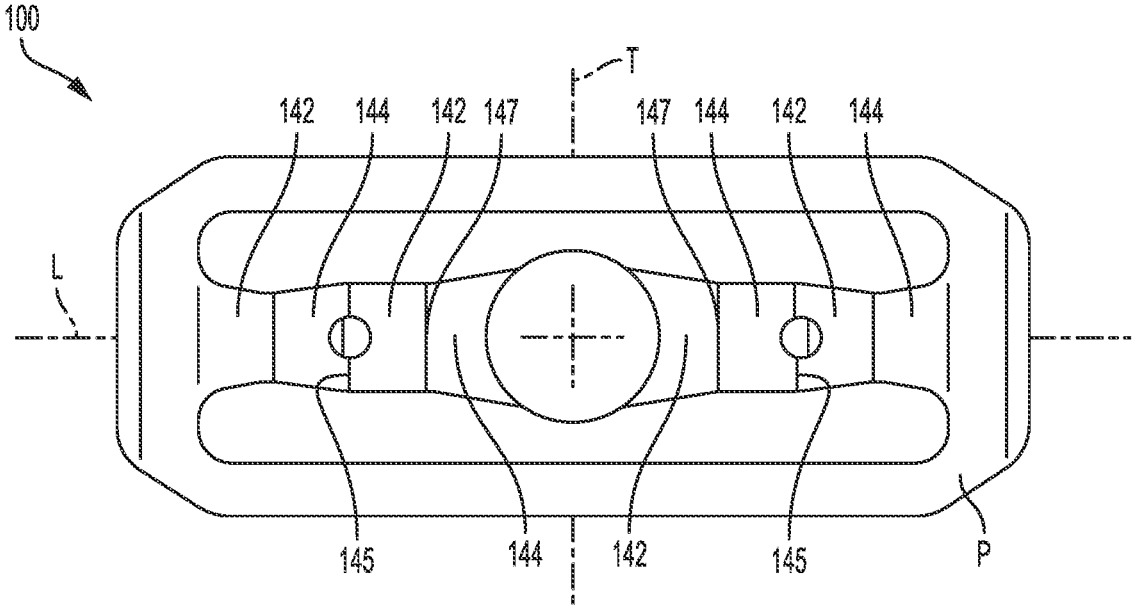
FIG. 13 is a top view of the track connector of FIG. 11.

Referring to FIGS. 8 and 10, each of the first and second posts 45, 46 is essentially identical in size and shape to each hole 34 proximal each longitudinal end of each track section 12. Each half of the third post 47, on either side of the transverse centerline 15*b*, is essentially identical in size and shape to the cutout 36 at each longitudinal end of each track section 12, 12' so that the posts 45, 46 can be received in holes 34 and the third post 47 received in a circular opening defined by the two semicircular cutouts 36 at adjoining ends of two of the track sections 12, 12'. The fit between posts 45, 46 and holes 34 is preferably selected for a desired positive degree of frictional engagement. There need not be comparable or any frictional engagement between the third post 47 and the adjoining cutouts 36 but it should be appreciated that the closer the fit between the third post 47 and each cutout 36, combined with the fit between either post 45, 46 and the hole adjoining the cutout, the more rigidly the track section 12, 12' is held in parallel alignment with the connector 14 and with the end of any other track section held by the remaining end of the connector. To that end, the minimum distance between each post 45, 46 and the third post 47 can be selected to be slightly less than the minimum distance between the hole 34 and cutout 36 at each longitudinal end of the track section so that the portion of the track section 12 hole 34 and cutout 36 can be held in a degree of compression between the third post 47 and one of the other posts 45, 46, if desired.

Figure 9:
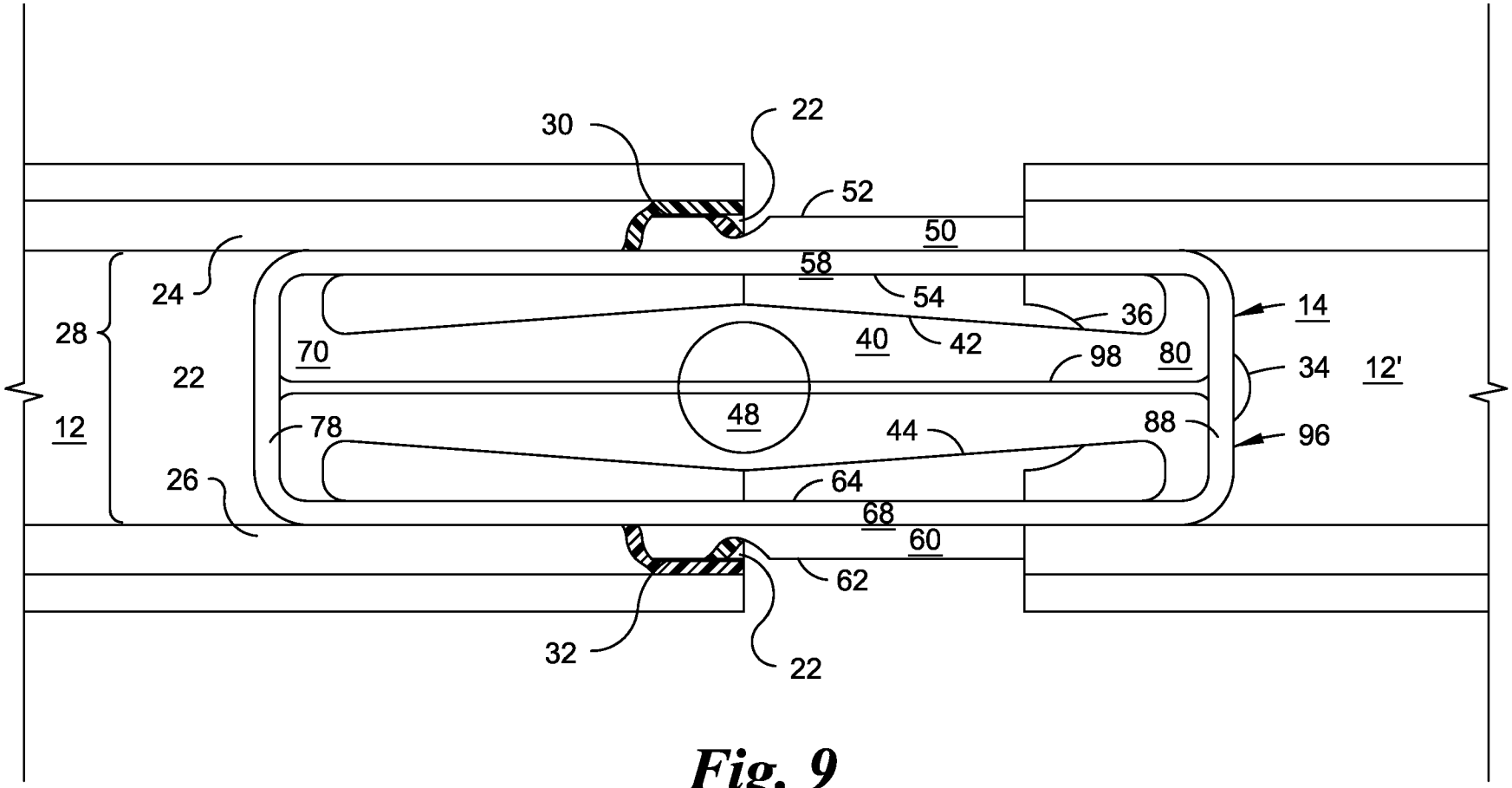
FIG. 9 is a bottom view of the track connector and the first and second track sections of FIG. 8.

Referring to FIG. 9, it can be seen that the two longer ribs 58, 68 are spaced apart a distance substantially equal to the spacing between the inner edges of the inwardly turned distal portions of each of the flange elements 24, 26 so that the rib frame 96 slides between and fits closely with those inner edges while the remainder of the outer portions 50, 60 outward of the ribs 58, 68 are received in the respective enclosures 30, 32. The connectors 14 and track sections 12 are sufficiently flexible so that an end portion 70 or 80 of the connector 14 can be inserted into a longitudinal end of a track section 12, with the angled corner edges 74, 76 or 84, 86 helping to align the ends, and the connector 14 slid into the bottom channel 28 with the outer portions 50, 60 sliding into the enclosures 30, 32 until the post 45 or 46 engages with the proximal hole 34. The depth of the ribs 58, 68, 78, 88 is preferably no greater than the thickness of the inwardly turned distal portions of the flange elements 24, 26 so that the bottommost surfaces of the flange elements 24, 26 and the ribs 58, 68, 78, 88 are essentially flush. Also, the separation of the outer sides of the longer ribs 58, 68 is nearly equal to the separation of the innermost distal edges of the flange elements 24, 26 so that the rib frame 96 maintains the longitudinal centerline 13*a* of the engaged track section 12 parallel to that 15*a* of the connector 14 and thus to that 13*a* of the second track section 12' attached to the connector. Again, each of these various parts of the track sections 12 and connectors 14 can be dimensioned for the materials used to provide a desired amount of frictional force and engagement between the mating elements.

Separation of a pair of joined track sections 12, 12' is assisted by the provision of the third post 47. Referring to FIG. 10, the top surface 47*a* of the third post 47 is sufficiently large so as to be able to receive the end of a child's thumb, which can be used to push inwardly/downwardly on the top of the third post 47 while holding and bending the two joined track sections 12, 12' away from the upper major surface 38 of the connector 14, until the holes 34 separate from the first and second posts 45, 46. This separation is aided by the provision of the bevels 45*b*, 46*b*, to the top surface 45*a*, 46*a*, of each post 45, 46, which minimize the distance the inward edge of each hole 34 has to side in contact with the circular outer surface of each post 45, 46.

It should be readily apparent that with the present track system there is interference engagement between the new track connector 14 and joined track sections 12, 12', as well as frictional engagement, to more securely hold together and maintain in alignment the joined track sections 12, 12'. Further because of the provision of the rib frame, the connected track sections 12, 12' are aligned more truly and that alignment maintained during use. The new sets remain relatively easy and less expensive to manufacture than other improvement options tried before.

Example 3

This example describes another illustrative connector suitable for connecting track sections of the present disclosure; see FIGS. 11-16.

Referring now to FIGS. 11-16, another example of connector 14 is shown, which is generally indicated at 100. Unless explicitly stated, connector 100 may include one or more components of connector 14.

Connector 100 includes a base or central portion 102, opposed first and second end portions 104 and 106, and opposed first and second side portions 108 and 110. First and second end portions 104 and 106 and first and second side portions 108 and 110 may collectively define a perimeter 112 of connector 100. The perimeter may sometimes be referred to as forming a "frame" for the central portion. Perimeter 112 defines a plane P. Central portion 102 is disposed between the first and second end portions and between the first and second side portions to form or define a first elongate hole 114 between the first side portion and the central portion (and between the first and second end portions), and a second elongate hole 116 between the central portion and the second side portion (and between the first and second end portions).

Figure 15:
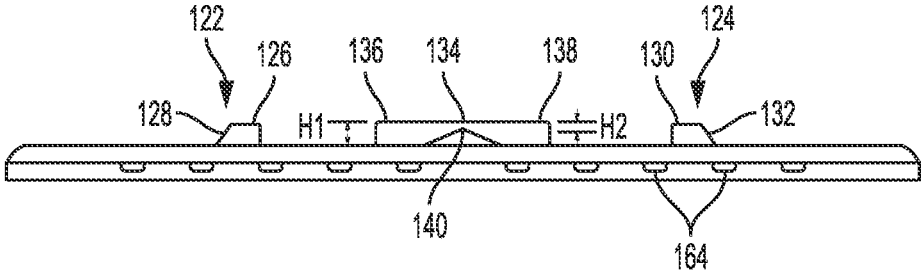
FIG. 15 is a side view of the track connector of FIG. 11.
Figure 16:
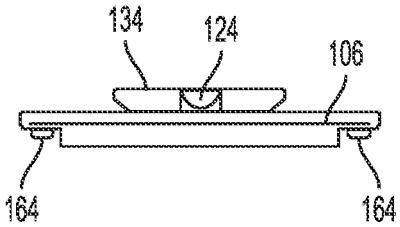
FIG. 16 is an end view of the track connector of FIG. 11.

Central portion 102 includes an upper face 118 and a lower face 120. A first post 122 and a second post 124 extend or project outward from the upper face. The first and second posts are positioned the same distance from a transverse centerline T of the connector. The posts have a circular cross-section at the upper face, but may alternatively be any suitably shaped cross-section configured to be received in a hole of a track section 12 (such as hole 34 of track section 21 shown in FIGS. 8-10 and/or hole 234 in track section 212 in FIGS. 17-19). First post 122 includes a first top surface 126 and a first bevel 128, while second post 124 includes a second top surface 130 and a second bevel 132, as best shown in FIG. 15. The first and second bevels extend downward from the first and second top surfaces, respectively. Additionally, the first and second bevels face toward the first and second end portions, respectively, to facilitate insertion of connector 100 between track sections. In other words, the first and second bevels allow the post to move underneath the track section as the connector is being inserted into the channel of the track section (or as the track section is being moved toward the connector while the connector is in the channel of the track section).

A third or central post 134 extends or projects outward from the upper face. The third post is disposed between the first and second posts. In some embodiments, the third post is centered between the first and second posts. Third post 134 has a circular cross-sectional area that is larger or substantially larger than the first and second posts. For example, the cross-sectional area of the third post may be equal to or greater than the total cross-sectional area of the first and second posts. However, the third post may include a cross-section that is another shape, such as a square or triangular cross-section. Central portion 102 flares outward around the third post to accommodate the larger size of that post.

The third post includes a first portion 136, a second portion 138, and a living hinge 140 disposed between (and connecting) the first and second portions, as best shown in FIG. 15. The first and second portions may have the same cross-sectional area, or one of the portions may be larger than the other portion. First portion 136 and second portion 138 may, for example, be oppositely inclined or sloped portions having a first height H1 along its ends (furthest from the living hinge) and a second height H2 that is substantially less than the first height adjacent the living hinge, as shown in FIG. 15.

Living hinge 140 allows the first and second portions to pivot or rotate relative to each other, such as when a force is applied on the third post. For example, living hinge 140 allows the first and second portions to pivot or rotate upward and/or outward about transverse centerline T when a downward force (or a force perpendicular to the transverse and/or longitudinal centerlines) is applied to the third post. The living hinge is along the transverse centerline and defines the first and second portions, but the living hinge may deviate or be outside the transverse centerline. Living hinge 140 is a thinned or cut area (or area of reduced height or thickness) in lower face 120 to allow the first and second portions to bend along the line of the hinge. The living hinge makes it easier to detach the track section from the connector (or the connector from the track section) by providing additional flexibility and/or vertical displacement. For example, the living hinge allows the central portion to move perpendicular to the longitudinal and transverse centerlines relative to the first and second outer portions and the first and second end portions. Although only a single living hinge 140 is shown, the third post may include two or more living hinges that define or divide three, four, or more portions of the third post. Additionally, although third post 134 is shown with a living hinge 140, the third post may alternatively not include the living hinge, such as the third post in connector 14 described above.

Central portion 102 has an accordion, wavy, or saw-tooth shape along its length (or along a longitudinal centerline L). For example, when viewed left to right in FIG. 13, central portion 102 includes sloping surfaces, such as descending surfaces or parts 142 and ascending surfaces or parts 144, which define peaks or ridges 145 and valleys or grooves 147. For example, any two adjacent sloping surfaces may define either a peak 145 or a valley 147 therebetween. When viewed left to right in FIG. 13, descending surfaces start within plane P and descend away from (or below) that plane, while ascending surfaces start outside of (or below) plane P and ascend toward that plane. In the example shown, central portion 102 includes four descending surfaces 142 and four ascending surfaces 144, but the central portion may have three or less descending and/or ascending surfaces, or five or more descending and/or ascending surfaces. The first, second, and third posts are positioned or located in the peaks or ridges.

The central portion may alternatively, or additionally, be corrugated, crimped, rippled, jagged, or pleated. When corrugated, the corrugations may be rounded, semi-rounded, semi-sharp, or sharp. Although central portion 102 is shown to have an accordion shape throughout its length, the central portion may alternatively include the accordion shape along less than all of its length, such as along only half its length (e.g., only between the first end portion and the third post, only between the third post and the second end portion, only between the first and second posts, etc.). Alternatively, central portion 102 may be planar similar to connector 14 above.

Figure 14:
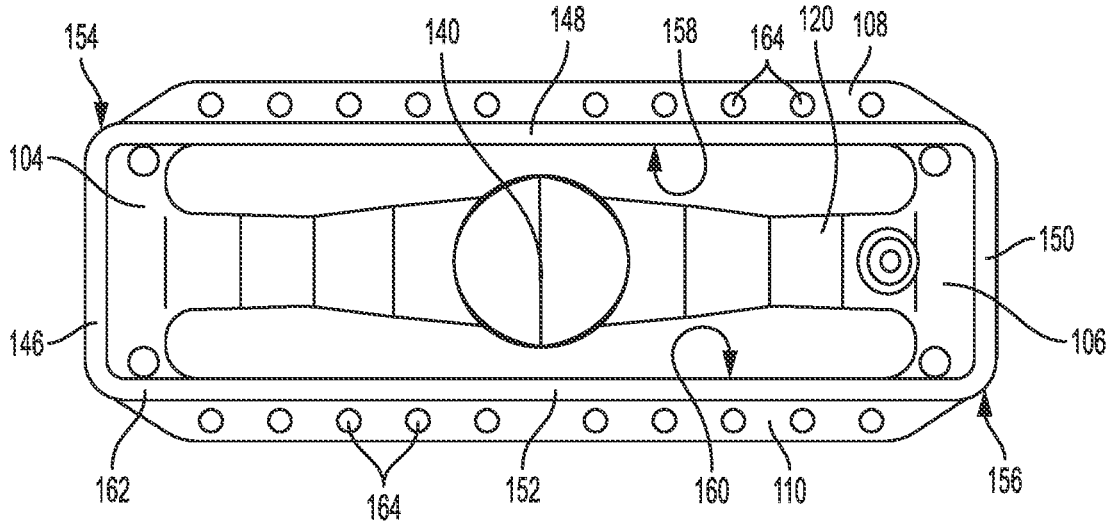
FIG. 14 is a bottom view of the track connector of FIG. 11.

Connector 100 additionally includes elongated ribs 146, 148, 150, and 152 that extend or project outward from lower face 120 along first and second end portions 104 and 106 and first and second side portions 108 and 110, as best shown in FIG. 14. Ribs 146 and 150 are parallel to each other and are along outer edges 154 and 156 of the first and second end portions, respectively. Ribs 148 and 152 are parallel to each other (and perpendicular to ribs 146 and 150) and are along inner side edges 158 and 160 of the first and second side portions, respectively. Although ribs 146 and 150 are along the outer edges of the first and second end portions, those ribs may alternatively be along inner edges of those end portions or somewhere between the outer edges and inner edges. Additionally, although ribs 148 and 152 are along the inner side edges of the first and second side portions, those ribs may alternatively be along outer side edges of those side portions or somewhere between the outer side edges and the inner side edges. Ribs 146, 148, 150, and 152 are connected to form an integral rib frame 162 along the perimeter of the connector.

Connector 100 further includes a plurality of bumps, knobs, bulges, nubs, or protuberances 164 along the first and second side portions. The bumps may be any suitable number, shape(s), and/or size(s) that provide for frictional engagement of the track sections when the connector is inserted in the channels of those track sections. Although bumps 164 are shown along the first and second side portions, the connector may alternatively include wider elongated ribs 148 and 152 or additional ribs along those side portions.

Although connector 100 is shown in FIGS. 11-16 to include an accordion central portion 102, a living hinge 140, and bumps 164, other examples of connector 100 may include less or additional features. For example, another example of connector 100 may include only the living hinge and have a planar central portion (and not include an accordion central portion). A further example of connector 100 may include only the accordion central portion and not include the living hinge and/or bumps.

Example 4

Figure 17:
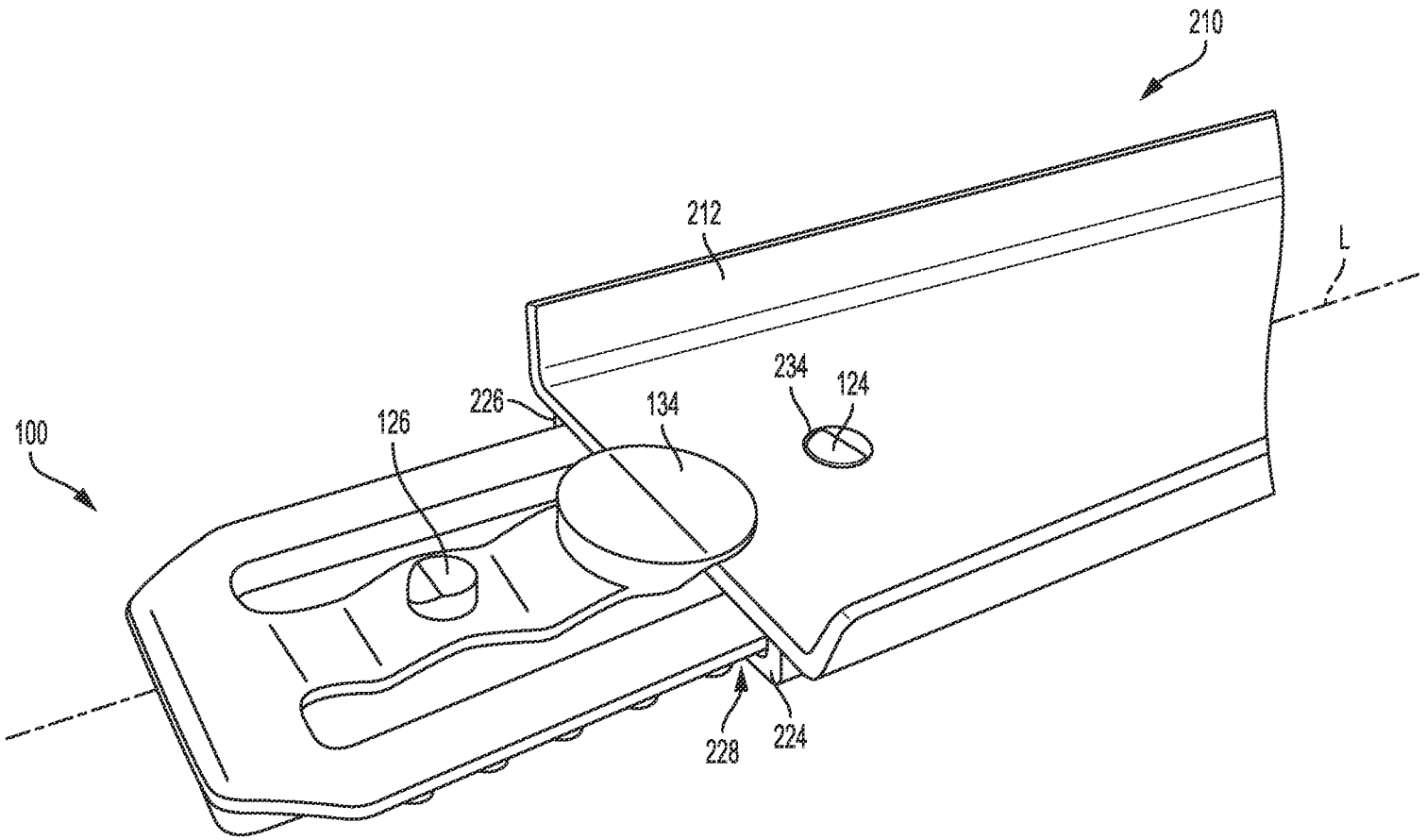
FIG. 17 is a top isometric view of the track connector of FIGS. 11-16 joined to a first track section of the present disclosure.
Figure 18:
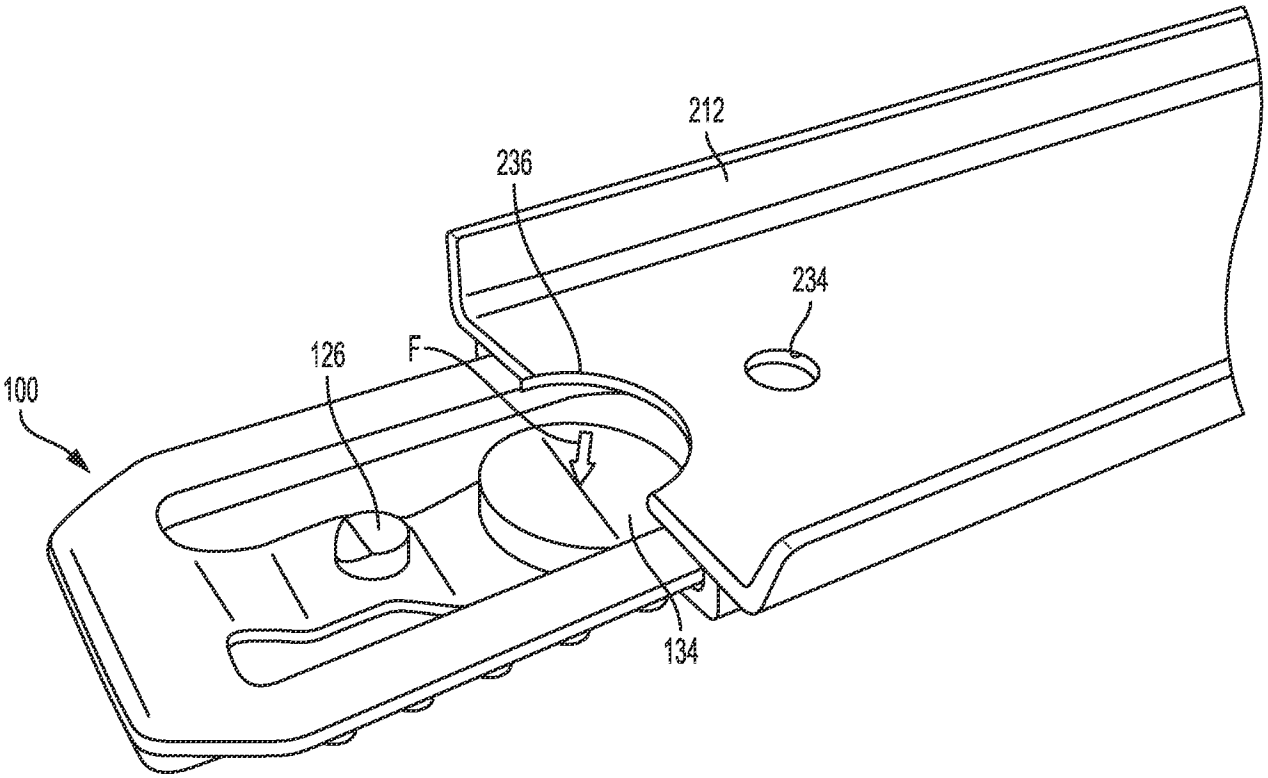
FIG. 18 is a top isometric view of the track connector and first track section of FIG. 17 shown when a downward force is applied to a third post of the track connector to enable detachment of the track connector from the first track section.
Figure 19:
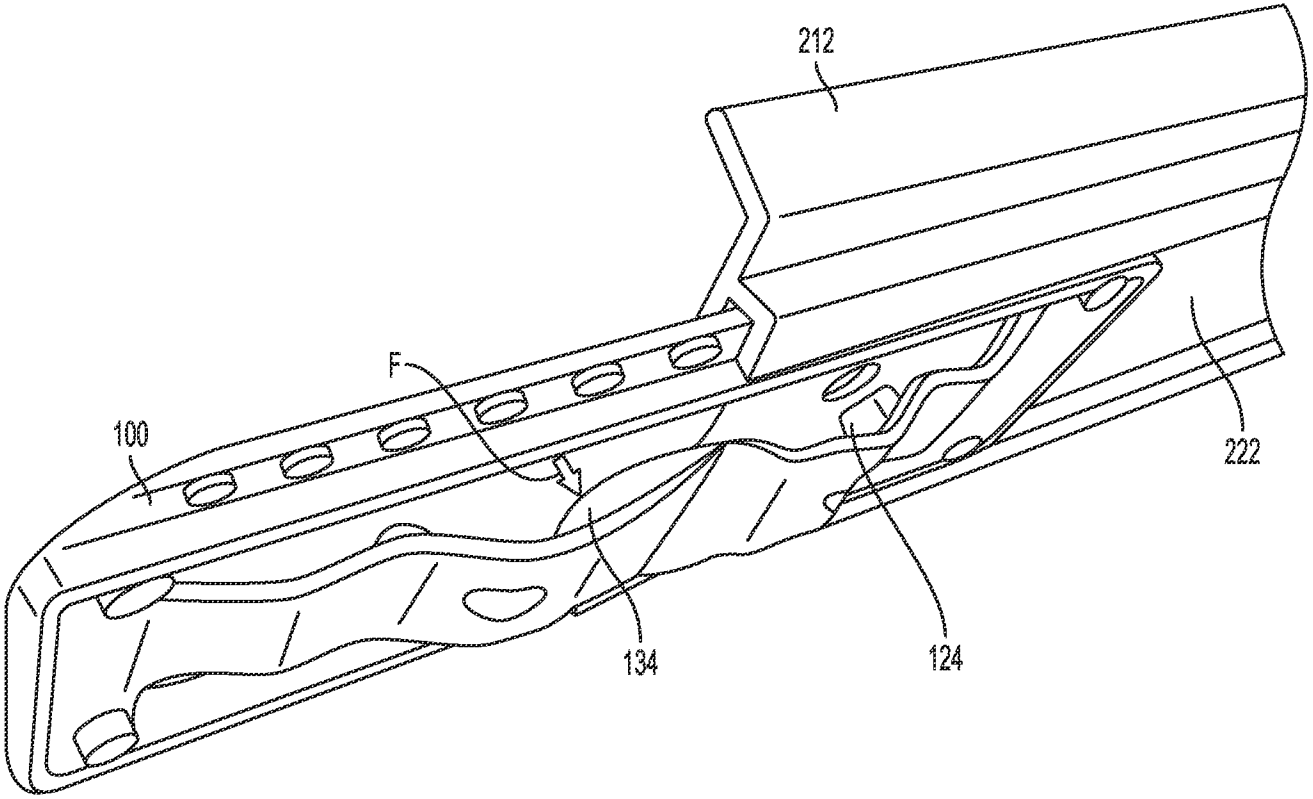
FIG. 19 is a bottom isometric view of the track connector and first track section of FIG. 18.

This example describes another illustrative vehicle track system with the connectors described in Example 3; see FIGS. 17-19.

Referring now to FIGS. 17-19, an example of a vehicle track system 10 is shown, which is generally indicated at 210. Unless explicitly stated, vehicle track system 210 may include one or more components of vehicle track system 10. Vehicle track system 210 is similar in many respects to vehicle track system 10 described in Examples 1 and 2 but with the connectors described in Example 3. Components or parts of vehicle track system 210 correspond to components or parts of vehicle track system 10, and are labeled, when shown, with similar reference numbers having the general form "2XX" rather than "XX." Accordingly, features 212, 216, 218, 220, 222, 224, 226, 228, 234, 235, and 236 may be identical or substantially identical to their respective counterparts in Example 1, namely features 12, 16, 18, 20, 22, 24, 26, 28, 34, 35, and 36.

Track section 212 includes flange elements 224 and 226 that extend parallel to a longitudinal centerline L of the track section. The flange elements form a channel 228 which defines a receptacle or a receiving portion for connector 100. Track section 212 includes an opening or hole 234 and an open perimeter cutout 236. The hole is circular and the cutout is semicircular but may be different shapes to match the shapes of the first, second, and/or third posts of connector 100. For example, hole 234 may be square or triangular when the first and second posts are square or triangular. Additionally, cutout 236 may be rectangular when the third post is square.

To connect two track sections, connector 100 is inserted into channel 228 of one track section until one of the first post 122 and second post 124 is received in hole 234 and about half of third post 134 is received in cutout 236, as shown in FIG. 17. The bevel of the first and second posts vertically displaces the post away from bottom face portion 222 as the connector is inserted into channel 228. The remaining portion of connector 100 is then inserted into channel 228 of the other track section and the same process is repeated.

To remove connected track sections, a user applies a downward force F on the top surface of the third post (e.g., perpendicular to top face portion 216 of the track sections) shown in FIGS. 18-19, which vertically displaces central portion 102 away from bottom face portion 222 of the track sections. As best seen in FIG. 19, living hinge 140 and/or the accordion-shape of central portion 102 allow the user to displace the central portions such that the third post is away from the bottom face portion of the track section and beyond the plane defined by perimeter 112 (such as the bottom surface of the perimeter) and/or is no longer located within the plane defined by the perimeter. When the central portion is displaced away, the first, second, and third posts are displaced away from the holes 234 and cutouts 236, allowing a user to separate the track sections and connector. When downward force F is removed, the central portion returns to its nominal or original position that is within the plane of perimeter 112.

Example 5

Figure 20:
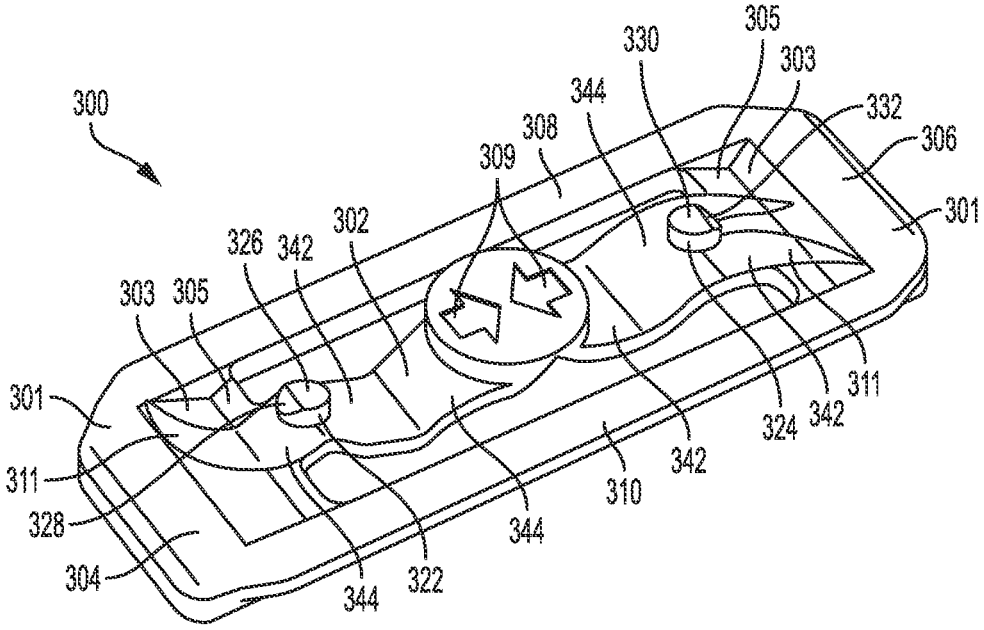
FIG. 20 is an isometric view of a further example of a track connector of the present disclosure.

This example describes a further illustrative connector suitable for connecting track sections of the present disclosure; see FIG. 20.

Referring now to FIG. 20, another example of connector 14 is shown, which is generally indicated at 300. Unless explicitly stated, connector 300 may include one or more components of connectors 14 and 100. Connector 300 is similar in many respects to connector 100 described in Example 3, but with larger first and second end portions, a shorter and different-shaped central portion, smaller bevel for the first and second posts, and various surface features on the upper face, as further described below. Components or parts of connector 300 correspond to components or parts of connector 100, and are labeled, when shown, with similar reference numbers having the general form "3XX" rather than "1XX." Accordingly, features 308, 310, 312, 314, 316, 318, 320, 322, 324, 326, 328, 330, 332, 334, 336, 338, 340, 342, 344, 346, 348, 350, 352, 354, 356, 358, 360, 362, and 364 may be identical or substantially identical to their respective counterparts in Example 3, namely features 108, 110, 112, 114, 116, 118, 120, 122, 124, 126, 128, 130, 132, 134, 136, 138, 140, 142, 144, 146, 148, 150, 152, 154, 156, 158, 160, 162, and 164.

Connector 300 includes a central portion 302, first and second end portions 304 and 306, and first and second side portions 308 and 310. The central portion has a curvilinear shape that flares outward from first end portion 304 to second end portion 306. When viewed left to right in FIG. 20, central portion 302 includes three descending parts or surfaces 342 and three ascending parts or surfaces 344, and each of the first and second end portions includes a planar portion 301, a descending portion 303, and an ascending portion 305. The planar portion is within a plane defined by first and second side portions 308 and 310.

First post 322 includes a first top surface 326 and a first bevel 328, while second post 324 includes a second top surface 330 and a second bevel 332. The first and second bevel extend downward from the first and second top surfaces. As compared to connector 100, the first and second bevels are smaller because those bevels extend downward from less than midpoint of the respective top surfaces.

Connector 300 additionally includes surface features on central portion 302 and the first and second end portions. The surface features include arrows 309 on the top surface of third post 334, which may indicate to a user where to press down. The arrows are depressions from the plane of the top surface of the third post, but may alternatively be protrusions from the plane of that surface. The surface features also include flames 311, which project outward from the first and second end portions and provide visual continuity for the central portion.

Example 6

This section describes additional aspects and features of vehicle track systems and connectors, presented without limitation as a series of paragraphs, some or all of which may be alphanumerically designated for clarity and efficiency. Each of these paragraphs can be combined with one or more other paragraphs, and/or with disclosure from elsewhere in this application, including any materials incorporated by reference, in any suitable manner. Some of the paragraphs below expressly refer to and further limit other paragraphs, providing without limitation examples of some of the suitable combinations.

A0. A one-piece, elongated, molded plastic connector configured to join together at least a pair of toy vehicle track sections, the connector comprising:

an elongated central portion with opposing upper and lower faces, the central portion having opposed first and second elongated side edges;

a first elongated outer portion spaced from the first elongated side edge;

a second elongated outer portion spaced from the second elongated side edge;

first and second end portions joining the central portion and the first and second outer portions to define opposing elongated ends of the connector;

the central portion and the first and second end portions having a common longitudinal centerline in an elongated direction between the opposing ends, the central portion and the first and second outer portions having a common transverse centerline perpendicular to the longitudinal centerline;

first and second posts projecting outwardly from the upper face of the central portion at positions along the longitudinal centerline and on opposite sides of the transverse centerline; and a third post projecting outwardly from the upper face between the first and second posts, the third post being centered with respect to the longitudinal and transverse centerlines, the third post having a living hinge.

A1. The connector of paragraph A0, wherein the central portion includes a plurality of sloping surfaces that forms a plurality of peaks and a plurality of valleys.

A2. The connector of paragraph A1, wherein the first and second posts project from different peaks of the plurality of peaks.

A3. The connector of any of paragraphs A1-A2, wherein the third post projects from a peak of the plurality of peaks.

A4. The connector of any of paragraphs A0-A3, wherein the living hinge is along the transverse centerline.

A5. The connector of any of paragraphs A0-A4, wherein the living hinge is a thinned area of the third post.

A6. The connector of any of paragraphs A0-A5, wherein the third post has a cross-section at the upper face larger in area than the circular cross-sectional area of each of the first and second posts at the upper face.

A7. The connector of any of paragraphs A0-A6, wherein the first and second posts each have a circular cross-section.

A8. The connector of any of paragraphs A0-A7, wherein the third post has a circular cross-section.

B0. The one-piece elongated molded plastic connector of any of paragraphs A0-A8 in combination with a pair of toy vehicle track sections, each of the track sections comprises:

a first face portion extending a length of the track section so as to support a toy vehicle between opposing longitudinal ends of the track section and oppositely disposed guide flanges extending essentially the length of the track section and projecting obliquely from the first face portion so as to maintain the toy vehicle on the first face portion of the track section;

a second face portion opposite the first face portion and at least two flange elements depending from the second face portion, the at least two flange elements being shaped and spaced sufficiently apart from one another to define enclosures for outer portions of the track connector with the track connector positioned between the flange elements;

an opening extending entirely through the track section through the first and second face portions proximal one longitudinal end of the track section, each opening being proximal to and spaced inwardly from an end edge of the longitudinal end supporting the opening, each opening being shaped and sized to closely receive either one of the first and second posts of the track connector received between the at least two flange elements; and a cutout in the end edge of the track section, the cutout extending entirely through the track section through the first and second face portions and being located proximal to the closed perimeter opening supported by the one longitudinal end, the cutout is shaped and sized to closely receive a portion of the third post of the track connector when the opening receives one of the first and second posts.

B1. The combination of paragraph B0, each flange element has a substantially L-shaped cross-section facing the other flange element.

B2. The combination of any of paragraphs B0-B1, where the opening is a closed perimeter opening.

B3. The combination of any of paragraphs B0-B2, where the cutout is shaped and sized to closely receive one half of the third post of the track connector.

C0. A one-piece, elongated, molded plastic connector configured to join together at least a pair of toy vehicle track sections, the connector comprising:

an elongated central portion with opposing upper and lower faces, the central portion having opposed first and second elongated side edges, the elongated central portion having a plurality of sloping surfaces that defines a plurality of peaks and a plurality of valleys;

a first elongated outer portion spaced from the first elongated side edge to define a first elongate hole therebetween;

a second elongated outer portion spaced from the second elongated side edge to define a second elongate hole therebetween;

first and second end portions joining the central portion and the first and second outer portions to define opposing ends of the connector, the central portion and the first and second end portions having a common longitudinal centerline in an elongated direction between the opposing ends, and the central portion and the first and second outer portions having a common transverse centerline perpendicular to the longitudinal centerline;

first and second posts projecting outwardly from the upper face of the central portion at positions along the longitudinal centerline and on opposite sides of the transverse centerline; and a plurality of elongated ribs projecting outwardly from the lower face along the first and second outer portions and along the first and second end portions.

C1. The connector of paragraph C0, further comprising a third post projecting outwardly from the upper face between the first and second posts, the third post having a living hinge.

C2. The connector of paragraph C1, wherein the living hinge is a thinned area of the third post.

C3. The connector of any of paragraphs C1-C2, wherein the third post is centered with respect to the longitudinal and transverse centerlines.

C4. The connector of any of paragraphs C1-C3, wherein the third post includes a cross-section at the upper face larger in area than the circular cross-sectional area of each of the first and second posts at the upper face.

C5. The connector of any of paragraphs C0-C4, wherein the plurality of elongated ribs includes two longitudinal ribs projecting from the lower face along inner side edges of the first and second outer portions facing the elongated side edges of the central portion.

C6. The connector of any of paragraphs C0-05, wherein the plurality of ribs includes two transverse ribs extending from the first and second end portions in elongated directions parallel to the transverse centerline.

C7. The connector of paragraph C5, wherein the plurality of ribs includes two transverse ribs extending between adjoining ends of the two longitudinal ribs such that the two longitudinal ribs and the two transverse ribs are connected end to end to form a hollow rib frame having a continuous, unbroken, closed circumference.

Advantages, Features, Benefits

The different embodiments of the toy vehicle track systems and connectors described herein provide several advantages over known toy vehicle track systems. For example, the connectors provide for easier release from the track sections by allowing greater vertical displacement of the first, second, and/or third posts away from the receiving structures of the track sections when a downward force is applied on the third post. Additionally, and among other benefits, illustrative embodiments of the toy vehicle track systems and connectors described herein allow for increased frictional engagement between the connector and the track sections because the increased vertical displacement of the first, second, and/or third posts allow for easier removal when a downward force is applied on the third post despite the increased frictional engagement. No known system or device can perform these functions. However, not all embodiments described herein provide the same advantages or the same degree of advantage.

CONCLUSION

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The claims below particularly point out certain combinations and subcombinations regarded as novel and nonobvious. Invention(s) embodied in other combinations and subcombinations of features, functions, elements, and/or properties may be claimed in applications claiming priority from this or a related application. Such claims, whether directed to a different invention or to the same invention, and whether broader, narrower, equal, or different in scope to the original claims, also are regarded as included within the subject matter of the invention(s) of the present disclosure.

What is claimed is:

1. A one-piece, elongated, molded plastic connector configured to join together at least a pair of toy vehicle track sections, the connector comprising:

an elongated central portion with opposing upper and lower faces, the central portion having opposed first and second elongated side edges, and also including a plurality of sloping surfaces that forms a plurality of peaks and a plurality of valleys;

a first elongated outer portion spaced from the first elongated side edge;

a second elongated outer portion spaced from the second elongated side edge;

first and second end portions joining the central portion and the first and second outer portions to define opposing elongated ends of the connector;

the central portion and the first and second end portions having a common longitudinal centerline in an elongated direction between the opposing ends, the central portion and the first and second outer portions having a common transverse centerline perpendicular to the longitudinal centerline;

first and second posts projecting outwardly from the upper face of the central portion at positions along the longitudinal centerline and on opposite sides of the transverse centerline; and a third post projecting outwardly from the upper face between the first and second posts, the third post being centered with respect to the longitudinal and transverse centerlines, the third post having first and second portions and a living hinge disposed therebetween configured to allow the first and second portions to pivot relative to each other when a force that is perpendicular to the transverse centerline and the longitudinal centerline is applied to the third post.

2. The connector of claim 1, wherein the first and second posts extend from different peaks of the plurality of peaks.

3. The connector of claim 2, wherein the third post extends from a peak of the plurality of peaks different from the first and second posts.

4. A one-piece, elongated, molded plastic connector configured to join together at least a pair of toy vehicle track sections, the connector comprising:

an elongated central portion with opposing upper and lower faces, the central portion having opposed first and second elongated side edges, the elongated central portion having a plurality of sloping surfaces that defines a plurality of peaks and a plurality of valleys;

a first elongated outer portion spaced from the first elongated side edge to define a first elongate hole therebetween;

a second elongated outer portion spaced from the second elongated side edge to define a second elongate hole therebetween;

first and second end portions joining the central portion and the first and second outer portions to define opposing ends of the connector, the central portion and the first and second end portions having a common longitudinal centerline in an elongated direction between the opposing ends, and the central portion and the first and second outer portions having a common transverse centerline perpendicular to the longitudinal centerline;

first and second posts projecting outwardly from the upper face of the central portion at positions along the longitudinal centerline and on opposite sides of the transverse centerline;

a third post projecting outwardly from the upper face between the first and second posts; and a plurality of elongated ribs projecting outwardly from the lower face along the first and second outer portions and along the first and second end portions.

5. The connector of claim 4, wherein the third post includes first and second portions and a living hinge disposed therebetween configured to allow the first and second portions to pivot relative to each other when a force that is perpendicular to the transverse centerline and the longitudinal centerline is applied to the third post.

6. The connector of claim 5, wherein the living hinge is a thinned area of the third post.

7. The connector of claim 5, wherein the third post includes a cross-section at the upper face larger in area than the circular cross-sectional area of each of the first and second posts at the upper face.

8. The connector of claim 4, wherein the plurality of elongated ribs includes two longitudinal ribs projecting from the lower face along inner side edges of the first and second outer portions facing the elongated side edges of the central portion.

9. The connector of claim 8, wherein the plurality of ribs includes two transverse ribs extending between adjoining ends of the two longitudinal ribs such that the two longitudinal ribs and the two transverse ribs are connected end to end to form a hollow rib frame having a continuous, unbroken, closed circumference.

10. The connector of claim 8, wherein the plurality of ribs includes two transverse ribs extending from the first and second end portions in elongated directions parallel to the transverse centerline.

* * * * *